United States Patent [19]

Kraft

[11] 4,214,806

[45] Jul. 29, 1980

[54] FAST RELEASE CONNECTOR

[76] Inventor: Russell H. Kraft, Rte. 82, R.D. No. 2, Hopewell Junction, N.Y. 12533

[21] Appl. No.: 61,277

[22] Filed: Jul. 27, 1979

[51] Int. Cl.[3] ..... H01R 9/10

[52] U.S. Cl. ..... 339/242; 174/72 R; 339/272 R

[58] Field of Search ..... 339/242, 272 R, 272 A, 339/272 UC; 174/72 R

[56] References Cited

U.S. PATENT DOCUMENTS

| | | | |
|---|---|---|---|
| 2,116,776 | 5/1938 | Bondeson | 339/272 R |
| 3,710,307 | 1/1973 | Cooper, Jr. | 339/272 R |

FOREIGN PATENT DOCUMENTS

| | | | |
|---|---|---|---|
| 666145 | 7/1963 | Canada | 339/272 R |
| 32208 | 5/1927 | France | 339/272 R |

*Primary Examiner*—Joseph H. McGlynn

[57] ABSTRACT

An electrically conductive connector adapted to be releasably coupled with a stud to form an electrical connection. The connector includes an electrical terminal with an electrically conductive terminal aperture. The aperture has a larger diameter than the stud so as to facilitate introduction of the stud therein. A set screw is threadedly mounted on the electrical terminal in position to be actuated from the exterior of the electrical terminal and to be reciprocally passed across the aperture to engage the stud inserted therein and form a fixed electrical connection between the stud and connector. Release of the set screw permits the stud to be removed from the connector. The aperture has a configuration to permit it to cooperate with the set screw and stud to stabilize the interconnection therebetween. This is particularly true when the connection is subjected to forces acting other than along the axis of the set screw that otherwise could cause loosening of the interconnection between stud and connector. At least one terminal port is provided to facilitate electrical connection to selected conductors.

7 Claims, 3 Drawing Figures

FAST RELEASE CONNECTOR

BACKGROUND OF THE INVENTION

Industry standardization on stud terminals for pad mounted transformers has led to a requirement for multiple tap connectors that can be easily removed without disturbing the individual connections.

A number of attempts have been made to meet this requirement by using an over-sized thread with the same number of threads per inch as the standard stud. This allows the connector to slide over the stud and, with pressure applied by one or two set screws against the stud, effect a current interchange as the threads on the connector and stud are forced together.

While a suitable current interchange can be made in this manner, the axial line of forces from set screw to thread does not provide sufficient mechanical stability to resist a force perpendicular to the axis formed by the set screw and locking threads.

This type of force could easily be encountered as an installer works on the connector to install a conductor in one of the multiple ports. It would be quite easy to unknowingly loosen the connector on the stud at this time. If this occurred, the current interchange would eventually overheat leading to complaints from the utility customers or eventually burn out of the connection.

SUMMARY OF THE INVENTION

With the above background in mind, it is among the primary objectives of the present invention to provide an improved connector of the above type with stabilizing means on the surfaces of the connector in engagement with the stud to provide a triangular configuration of forces that will resist movement from any forces applied to the connector. One manner in which it has been found that this type of triangular configuration of forces can be obtained is by utilizing a U-shaped groove in the threaded aperture of the connector. The groove forms two edges in contact with the stud which are angularly off set with respect to the axis of the set screw so as to form the triangular configuration of holding forces to act against a force applied to the interconnection between stud and connector. An effective location for the groove is directly opposite to the set screw inserted through the connector so that the central axis of the set screw is in alignment with the center of the groove. In this manner the edges of the groove are offset with respect to the central axis of the set screw and apply forces angularly displaced on the stud from the point of contact of the set screw.

It is contemplated that the interconnection and release of the stud and connector be quick and efficient. Release of the set screw permits the threaded stud to be freely pulled from the oversized threaded aperture in the connector. Locking is quickly and easily accomplished by threading the set screw inward to engage the stud, which has been freely inserted in the over-sized aperture, and press the stud against the edges of the groove thus forming the three pointed or triangular locking arrangement.

The present fast release connector is adaptable for use within the industry on standard stud terminals for pad mounted transformers, as discussed above, and is equally useful with multiple tap connectors that can be easily removed without disturbing individual connections.

In summary, an electrically conductive connector is provided which is adapted to be releasably coupled with a stud to form an electrical connection. The connector includes an electrical terminal having an electrically conductive terminal aperture. The aperture has a larger diameter than the stud so as to facilitate introduction of the stud therein. A set screw is threadedly mounted on the electrical terminal in position to be actuated from the exterior of the electrical terminal and to be reciprocally passed across the aperture to engage the stud inserted therein and form a fixed electrical connection between the stud and conductor. Release of the set screw permits the connector to be removed from the stud. Means is formed in the aperture to cooperate with the set screw and stud to stabilize the interconnection therebetween particularly when subjected to forces acting other than along the axis of the set screw that otherwise could cause loosening of the interconnection between stud and connector. At least one terminal port is provided to facilitate electrical connection to selected conductors.

With the above objectives among others in mind, reference is made to the attached drawings.

DETAILED DESCRIPTION

Figure 1:
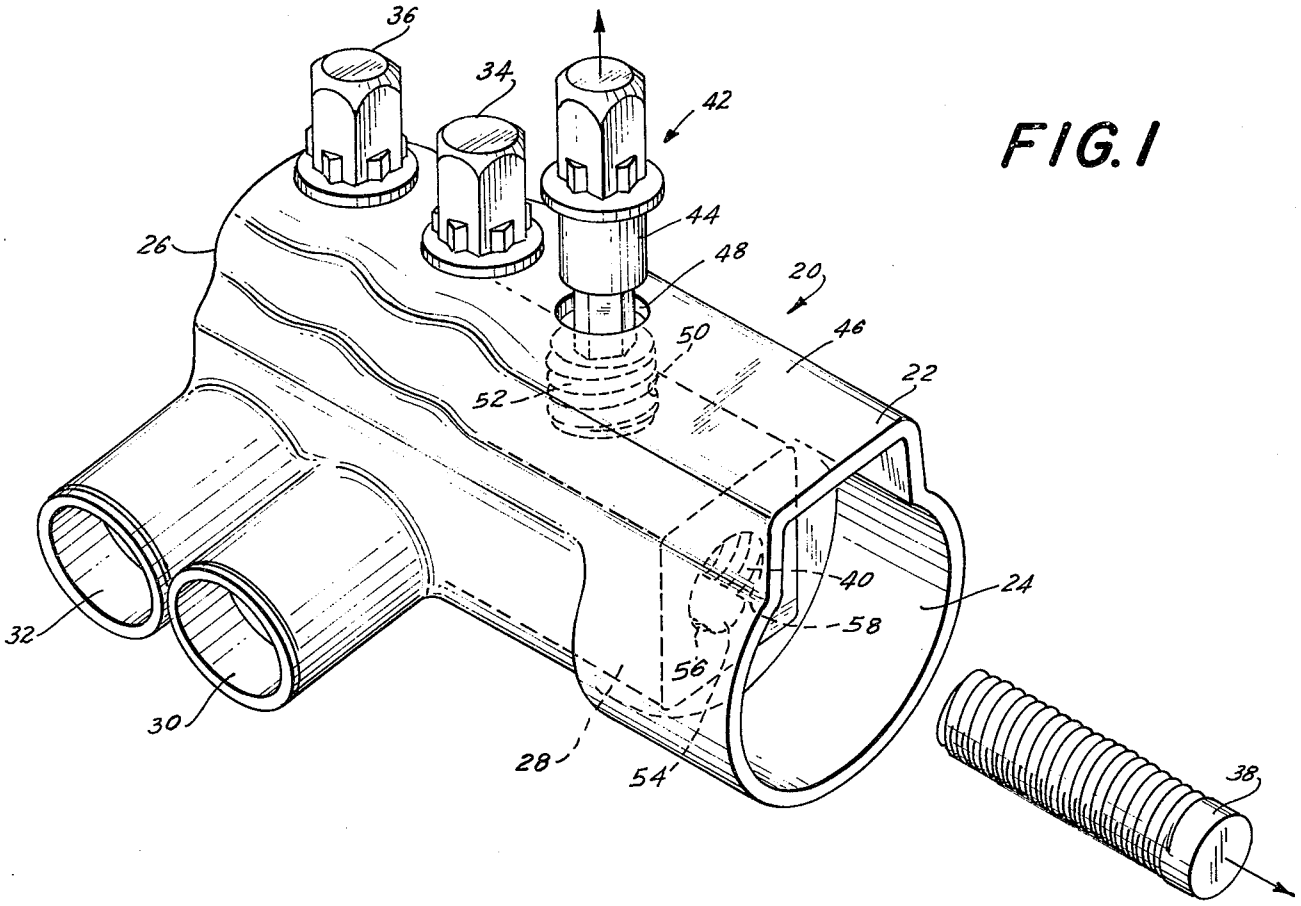
FIG. 1 is a perspective view of the connector of the invention and a stud to be coupled therewith.

As shown in FIG. 1 connector 20 includes a conventional housing 22 which may be formed of a readily available commercial plastic or other protective non-conductive material. Housing 22 has an open end 24 and a closed end 26. Within housing 22 is mounted an electrical terminal 28. Alternatively, in place of the housed or covered connector, a conventional base connector can be used for electrical terminal 28 without the necessity of the presence of a housing.

In the depicted embodiment, connector 20 has a pair of terminal ports 30 and 32 which are adapted to receive electrical conductors in electrical connection therein. Appropriate set screws 34 and 36 are provided to form the tight interconnection between conventional conductors (not shown), which are inserted through ports 30 and 32, electrical terminal 28 of the connector 20 in a conventional manner. The conductors are held in position by reciprocally threaded set screws 34 and 36 which are in alignment with ports 30 and 32 respectively. The number of ports is a matter of choice in a multiple tap connector of this type.

Terminal 28 has a threaded end aperture 40 which is perpendicular to ports 30 and 32 and which is in alignment with the open end 24 of the housing 22. This threaded aperture 40 is designed to receive reciprocally therein a mounting stud 38 of conventional nature which is provided on a conventional type of transformer (not shown). It is common to have the mounting stud 38 with a threaded outer surface as shown. To facilitate rapid interconnection between connector 20 and the transformer, threaded aperture 40 is larger in diameter than the threaded outer surface of stud 38.

Thus there is no interengagement between the threads when the stud 38 is passed through the open end 24 of the housing and into the threaded aperture 40 and the stud can be inserted directly in. It has been found effective to provide the same number of threads per inch on threaded aperture 40 as is present on the threaded outer surface of stud 38.

To form the interconnection between the stud 38 of the transformer and the connector 20, a reciprocally movable set screw or press screw 42 is provided. The upper end portion 44 of the set screw 42 extends upward out of an opening in the top 46 of housing 22. A shank portion extends through opening 48 in the housing and the end of the shank has a threaded outer surface 50 which is threadedly interengaged with a receiving aperture 52 in the top of terminal 28. The receiving aperture 52 passes through the terminal in a perpendicular direction with respect to aperture 40 and extends into communication therewith. Rotation of the upper portion 44 of the set screw 42 in one direction will direct the threaded end portion 50 into the aperture 40 and into engagement with the threaded outer surface of stud 38 to lock the stud in electrical connection with connector 20.

Figure 3:
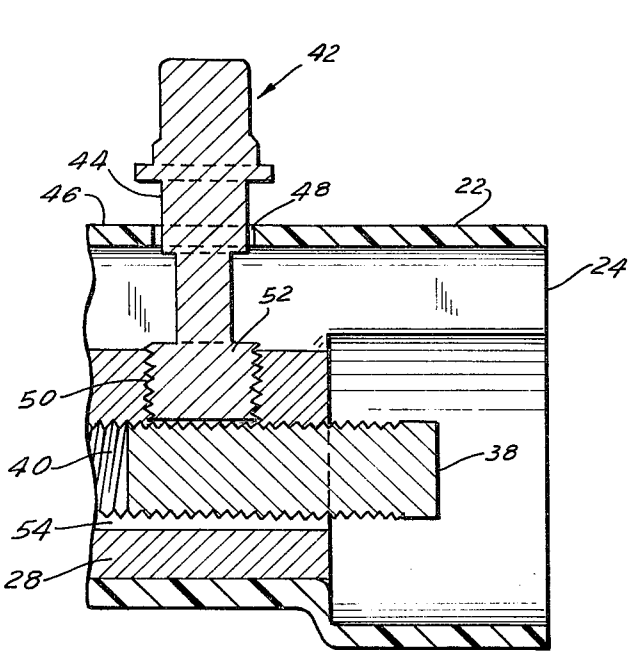
FIG. 3 is a fragmentary sectional view thereof taken along the plane of line 3—3 of FIG. 2.
Figure 2:
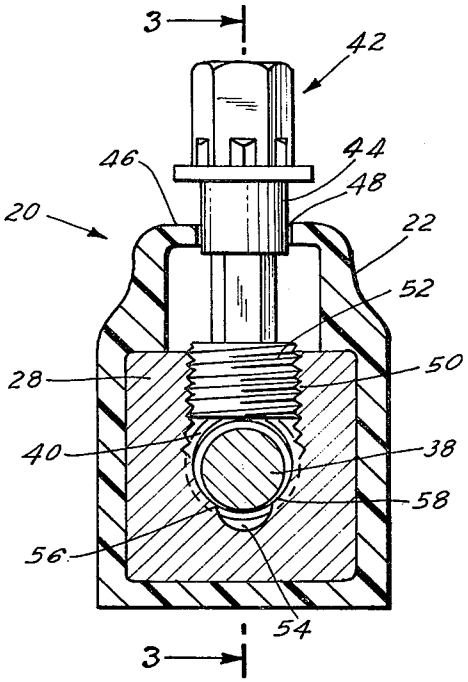
FIG. 2 is a sectional end view thereof with the stud mounted to the connector.

To facilitate stability of the locking interengagement, aperture 40 is provided with a U-shaped groove or recess 54 formed in its bottom portion with the center of the U-shaped recess 54 in alignment with the axis of the threaded lower end portion 52 of set screw 42. The recess extends sufficiently along the length of aperture 40 so that it is in vertical alignment with the press screw. Thus, when set screw 42 is threaded downward into engagement with stud 38 as shown in FIGS. 2 and 3, it will engage the top of the stud 38 and the stub bottom will be engaged at two points, the two edges 56 and 58 at both sides of the U-shaped groove 54. A three point contact is made with the stud 38 with points 56 and 58 being offset from the direct vertical point contact at the end of set screw 42 so that a triangular configuration of forces is provided to hold the stud in position and resist movement from any forces applied to the connector.

Release of the connector from the stud 38 is carried out in conventional fashion by grasping the exposed upper part 44 of the set screw 42 and rotating it in the direction to move the screw axially upward thereby freeing stud 38 for direct axial removal from the enlarged aperture 40 in the terminal 28 and the open end 24 of the housing 22 of connector 20. With the tight interconnection formed by the set screw and the grooved aperture 40, any number of connections and disconnections can be made through ports 30 and 32 without danger of loosening the connection between connector 20 and stud 38 of a transformer or similar structure. As stated above, the number of ports for connection to conductors is a matter of choice with two being shown in the depicted embodiment. Also, the shape and positioning of the groove 54 in aperture 40 is a matter of choice as long as at least the triangular three point contact is provided in cooperation with the set screw 42.

As stated above, although the transformer is not depicted, it is envisioned that a conventional type of pad mounted transformer can be utilized, specifically those which have threaded studs extending therefrom for mounting to connectors such as multiple tap connectors.

Thus, the advantages of the easily mountable and dismountable connector is provided with respect to a transformer utilizing the principle that the over-sized threaded aperture with the smaller diameter threaded stud which can be slipped in and out and connected and disconnected easily. The advantage of an axial line of force provided by a set screw or press screw against the thread is maintained acting in a perpendicular direction and the problem of the loosening of the connector is avoided with subsequent problems such as over heating or eventual burn out of the connection. This is accomplished by means of the triangular configuration of forces that resist movement from any forces applied to the connector.

In the depicted embodiment, the triangular action is accomplished by the groove or U-shaped recess formed in the base of the threaded aperture whereby the two edges of the groove form two points of contact along with the third point of contact from the base of the set screw extending downwardly from above. With the two edges of the groove being offset with respect to the downward pressure point through the axial center of the bottom of the set screw, the resolution of resultant forces provides support in the multiplicity of directions in addition to just top and bottom point or line pressure contact for support. Therefore, in addition to stability in just the vertical upward and vertical downward directions along the central axis, stability in angular and lateral directions is also achieved. Overall a better connection in interconnection with the transformer is the result.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

I claim:

1. An electrically conductive connector adapted to be releasably coupled with a stud to form an electrical connection comprising; an electrical terminal, an electrically conductive terminal aperture, the aperture having a larger diameter than the stud so as to facilitate introduction of the stud therein, a set screw threadedly mounted on the electrical terminal in position to be actuated from the exterior of the electrical terminal and to be reciprocally passed across the aperture to engage the stud inserted therein and form a fixed electrical connection between the stud and connector and release of the said screw will permit the stud to be removed from the connector, means formed in the aperture to cooperate with the set screw and stud to stabilize the interconnection therebetween particularly when subjected to forces acting other than along the axis of the set screw that otherwise could cause loosening of the interconnection between stud and connector, and at least one terminal port to facilitate electrical connection to selected conductors.

2. The invention in accordance with claim 1 wherein the electrical terminal is mounted in a housing, an opening in the housing communicating with the electrically conductive terminal aperture, the set screw being threadedly mounted on the housing in position to be actuated from the exterior of the housing and to be reciprocally passed diametrically across the aperture to engage the stud inserted therein to form the fixed electrical connection between the stud and connector.

3. The invention in accordance with claim 1 wherein the connector is a multiple tap connector with a plurality of terminal ports for installation of separate conductors to form electrical connections between each port and conductor respectively.

4. The invention in accordance with claim 1 wherein the stud is threaded and extends from a transformer, and the aperture is threaded and having a large enough diameter so that the threaded stud of the transformer passes into the threaded aperture without interengagement between the threads thereon.

5. The invention in accordance with claim 4 wherein the stud has the same number of threads per inch as the threaded aperture.

6. The invention in accordance with claim 1 wherein the means for stabilizing the interconnection between the set screw and the stud includes a groove formed in the wall of the aperture.

7. The invention in accordance with claim 6 wherein the groove is U-shaped in configuration and is positioned diametrically opposite to the set screw with the central axis of the set screw being located in approximate alignment with the center of the groove so that interengagement between the set screw and stud will direct the stud against the edges of the groove axially offset with respect to the central axis of the set screw thereby providing stabilizing forces with the holding forces of the edges of the groove acting angularly with respect to the holding force of the set screw thereby providing a triangular configuration of forces to resist movement due to forces applied to the connector when the connector and stud are coupled together.

* * * * *